US006909248B2

(12) United States Patent
Clark

(10) Patent No.: US 6,909,248 B2
(45) Date of Patent: Jun. 21, 2005

(54) DEUTERIUM ARC LAMP ASSEMBLY WITH AN ELAPSED TIME INDICATOR SYSTEM AND A METHOD THEREOF

(75) Inventor: David L. Clark, Horseheads, NY (US)

(73) Assignee: Heraeus Holding GmbH, Hanau (DE)

( * ) Notice: Subject to any disclaimer, the term of this patent is extended or adjusted under 35 U.S.C. 154(b) by 0 days.

(21) Appl. No.: 10/228,129

(22) Filed: Aug. 26, 2002

(65) Prior Publication Data

US 2004/0036425 A1 Feb. 26, 2004

(51) Int. Cl.[7] ..... H05B 37/02; H05B 37/04
(52) U.S. Cl. ..... 315/291; 315/129; 315/362
(58) Field of Search ..... 315/129, 130, 315/132, 133, 105, 106, 107, 307, 291, 131, 224; 340/691; H05B 37/02, 37/04

(56) References Cited

U.S. PATENT DOCUMENTS 3,769,582 A * 10/1973 Schoen ..... 377/12
3,988,626 A * 10/1976 Boudouris ..... 313/113
5,059,879 A * 10/1991 Watanabe ..... 318/603
5,493,181 A 2/1996 Shackle et al. ..... 315/241 R
5,798,614 A * 8/1998 Bishop ..... 315/107
6,153,987 A 11/2000 Toda et al. ..... 315/308
6,188,182 B1 * 2/2001 Nickols et al. ..... 315/294
6,292,339 B1 * 9/2001 Brooks ..... 361/78
6,307,332 B1 * 10/2001 Noguchi et al. ..... 315/362
6,413,210 B1 * 7/2002 Enomoto ..... 600/178
6,545,433 B2 * 4/2003 Beij et al. ..... 315/291
6,690,282 B2 * 2/2004 Miyashita et al. ..... 340/641
2002/0113560 A1 * 8/2002 Edwards et al. ..... 315/291

* cited by examiner

*Primary Examiner*—Trinh Vo Dinh
(74) *Attorney, Agent, or Firm*—Nixon Peabody LLP

(57) ABSTRACT

A lamp system includes a light source and an elapsed time indicator system which is coupled to the light source. The elapsed time indicator system accumulates a count of elapsed time of operation of the lamp system. The count provides an indication of a life span of the lamp system.

36 Claims, 1 Drawing Sheet

DEUTERIUM ARC LAMP ASSEMBLY WITH AN ELAPSED TIME INDICATOR SYSTEM AND A METHOD THEREOF

FIELD OF THE INVENTION

This invention relates generally to lamp assemblies and, more particularly, to a deuterium arc lamp assembly with an elapsed time indicator system and a method thereof.

BACKGROUND OF THE INVENTION

Basically, a deuterium lamp assembly has a cathode and an anode arranged within an evacuated glass envelope that contains deuterium gas. During operation, a stream of electrons flows from the cathode toward the anode exciting the gas within to produce light in the ultraviolet range.

The amount of time the deuterium lamp assembly is in operation may be monitored to provide an indication of the remaining life span of the deuterium lamp assembly. To monitor the amount of usage, existing deuterium lamp assemblies have used either mercury or copper coulombmeters. Unfortunately, there are obvious environmental issues with the use of mercury coulombmeters and copper coulombmeters are sensitive to orientation which can effect their proper operation.

SUMMARY OF THE INVENTION

A lamp system in accordance with one embodiment of the present invention includes a light source and an elapsed time indicator system which is coupled to the light source. The elapsed time indicator system accumulates a count of elapsed time of operation of the lamp system. The count provides an indication of a life span of the lamp system.

An elapsed time indicator system for a lamp assembly in accordance with another embodiment of the present invention includes a sensing system and a counter. The sensing system senses when the lamp assembly is in operation and the counter accumulates and provides a count of elapsed time of operation of the lamp assembly. The counter advances the count when the sensing system senses that the lamp assembly is in operation. The count provides an indication of a life span of the lamp system.

A method for monitoring usage of a lamp system in accordance with another embodiment of the present invention includes sensing when the lamp system is in operation and advancing a count when the sensing indicates the lamp system is in operation. The count provides an indication of a life span of the lamp system.

The present invention provides an effective system and method for monitoring usage of a lamp assembly. Additionally, the present invention eliminates the need of mercury contained in existing timers and eliminates the orientation limitations inherent with existing copper timers.

DETAILED DESCRIPTION

Figure 1:
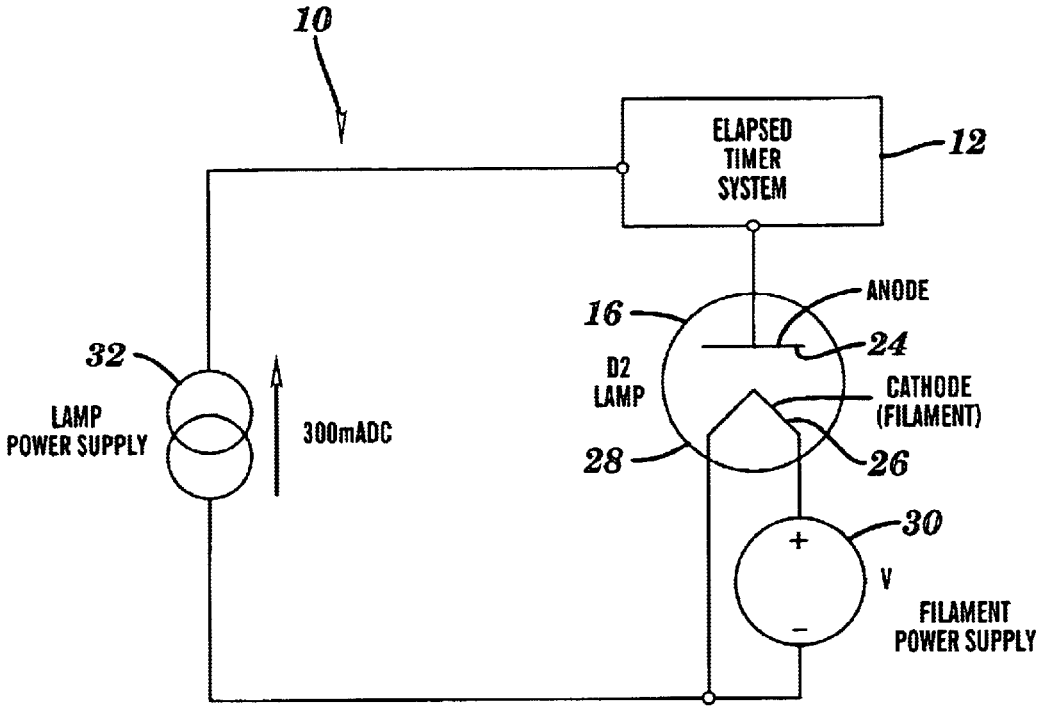
FIG. 1 is a partial schematic and partial block diagram of a lamp assembly with an elapsed time indicator system in accordance with an embodiment of the present invention.
Figure 2:
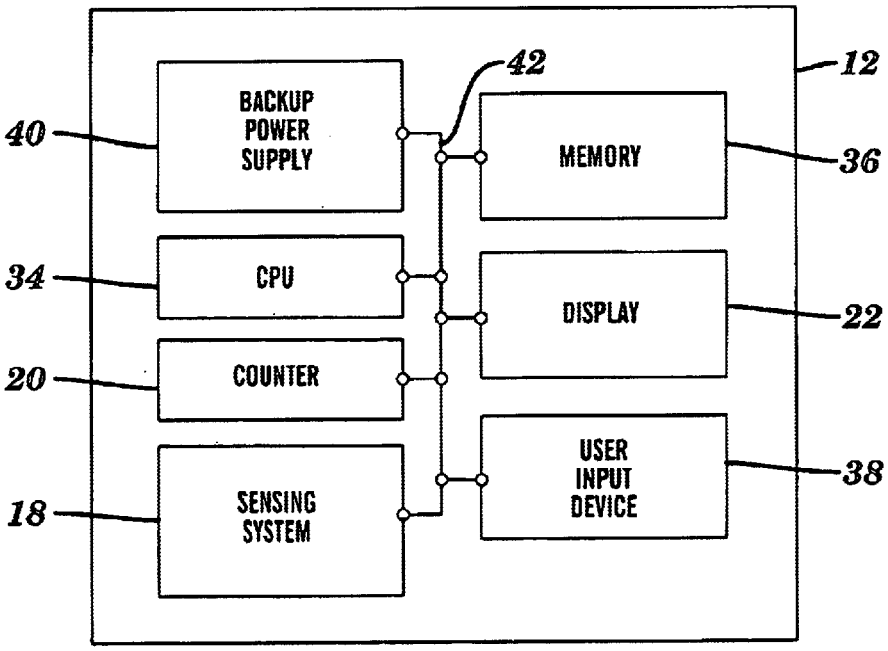
FIG. 2 is a block diagram on the elapsed time indicator system.

A lamp system or assembly 10 with an elapsed time indicator system 12 in accordance with an embodiment of the present invention is illustrated in FIGS. 1 and 2. The lamp system 10, such as a deuterium arc lamp system, includes at least one power supply 32, a light source or lamp 16, and an elapsed time indicator system 12 with a sensing system 18, a counter 20, and a display 22. The present invention provides an effective and accurate system 10 and method for monitoring usage of a light source 16.

Referring to FIG. 1, the light source 16 includes an anode 24 and a cathode filament 26 arranged in a spaced apart relationship within an evacuated glass envelope 28 which is subsequently filled with deuterium gas, although other types of light sources with other components and in other gases or a vacuum can be used.

In this particular embodiment, the light source 16 also includes a filament power supply 30 which is coupled to the cathode filament 26. The filament power supply 30 applies a starting voltage to heat-up the cathode filament 26, also known as a thermal electron emitter, to a point where electrons will be emitted from the cathode filament 26. The amount of the starting voltage which is applied depends on the type of light source 16 being used. Once the light source 16 starts, the voltage provided by the filament power supply 30 is reduced or switched off. The amount of voltage applied by the filament power supply varies depending on the type of light source 16 being used.

The lamp power supply 32 is coupled via leads to the anode 24 and the cathode filament 26 in the envelope 28. The lamp power supply 32 includes a switch which controls when current is supplied to the light source 16. In this particular embodiment, the lamp power supply 32 is a constant-current source, regulated at about 300 mADC current operating at a starting voltage range of about 250 VDC to about 750 VDC and an operating voltage range between about 60 VDC to about 90 VDC, although other types of lamp power supplies operating at other currents and voltages can be used.

Referring to FIGS. 1 and 2, the elapsed time indicator system 12 accumulates and displays the amount of time that the light source 16 has been operating. In this particular embodiment, the elapsed time indicator system 12 is shown separate from the light source 16, although elapsed time indicator system 12 may be incorporated into one package with the light source 16. The elapsed time indicator system 12 includes a sensing system 18, a counter 20, a display 22 or graphical user interface, a central processing unit (CPU) or processor 34, a memory 36, a user input device 38, and a backup power supply 40 which are coupled together by a bus system 42 or other link, respectively, although the elapsed time indicator system 12 may comprise other components, other numbers of the components, and other combinations of the components.

The sensing system 18 senses when current is flowing in the lamp system 10 and signals the counter 20 to advance the count of elapsed time of operation when the current is flowing, although the sensing system 18 could signal to advance the count in the counter based on sensing other characteristics which indicate that the light source is in operation, such as sensing the application of a pulsed current or the application of a voltage to the light source 16. The sensing system 18 signals the counter 20 to stop the count of elapsed time of operation when the flow of current is no longer sensed, although the sensing system 18 could stop the count in the counter 20 based on sensing other characteristics which indicate that the light source 16 is no longer in operation, such as sensing that a pulsed current has stopped or that a voltage is no longer being applied to the light source 16. A variety of different types of sensing systems which sense one or more characteristics can be used for sensing system 18, such as a sensing system that senses a constant current, a pulsed current, or a voltage.

The counter 20 is activated when the sensing system 18 senses a current or other characteristics applied to the light source 16 and upon activation begins or continues to accumulate a total time of operation of the light source 16. In this particular embodiment, the counter 20 is a microcontroller, although other types of sensing systems can be used.

The display 22 is used to show the count and may also be used to provide an expiration signal when the count reaches a set number which can vary based on the lamp system and can be input or altered by the operator. A variety of different of devices can be used for the graphical user interface or display 22, such as a CRT, LCD, or LED. In this particular embodiment, the display may show a reading up to 9999 or more hours, although this can vary, e.g. the display may be able to show a reading up to 99999. Most lamp systems or assemblies have an operating life of about 1000 to 2000 hours, although this can also vary based on the particular type of lamp system or assembly. Once the count reaches a milestone, such as 2000 hours for a lamp system or assembly with an expected life span of 2000 hours, then the system 12 may cause a unique readout to appear on the display, such as - - - - or 8888, although the type of unique readout can also vary. The system 10 can also provide some other type of notification that the life span of the lamp system is at or near its end. Although in this particular embodiment, the counter 20 and display 22 are shown as separate elements, the counter 20 and display 22 could be integrated as one device.

The processor 34 may execute one or more programs of stored instructions for the method for monitoring usage of a light source 16 as described herein. In this particular embodiment, these programmed instructions are stored in memory 36, although some or all of those programmed instructions could be stored and retrieved from and also executed at other locations. The memory 36 also stores information, such as accumulated operation time when the light source 16 is not in operation. A variety of different types of memory storage devices, such as a random access memory (RAM) or a read only memory (ROM) in the system or a floppy disk, hard disk, CD ROM, or other computer readable medium which is read from and/or written to by a magnetic, optical, or other reading and/or writing system that is coupled to the processor 40, can be used for memory 36.

The user input device 38 permits an operator to communicate with the elapsed time indicator system 12, such as a button which can be pressed to illuminate the display 22 to show the accumulated count. A variety of different types devices can be used for elapsed time indicator system 12, such as a button, buttons, keyboard, or a computer mouse.

The backup power supply 40 provides power to the elapsed time indicator system 12. With the backup power supply 40, functions of the elapsed time indicator system 12 can be accessed even when the lamp power supply 32 is off or disconnected from the light source 16, such as power to store the accumulated count in memory 36 or to illuminate or show the accumulated count on the display 22 when a user input device 38, such as a button, is activated.

The operation of the lamp system 10 will be described with reference to FIGS. 1 and 2. The filament power supply 30 is engaged to provide a starting voltage to the cathode filament 26. The starting voltage heats up the cathode filament 26 to a point where electrons are emitted from the cathode filament 26. The amount of the starting voltage which is applied depends on the type of light source 16 being used. Once the light source 16 starts to emit light, the voltage provided by the filament power supply 30 is reduced or switched off.

Meanwhile, the lamp power supply 32 is engaged and supplies a current, such as a constant current or repetitive pulses of current, to the light source 16. This current causes a stream of thermoelectrons to flow from the cathode filament 26 toward the anode 24 within the envelope 28 to produce light in the ultraviolet range.

When the lamp power supply 32 begins to supply a current to the light source 16, the sensing system 18 senses this flow of constant current, repetitive pulses of current, or some other characteristic that indicates the lamp system 10 is in operation and signals the counter 20 to begin counting, although the sensing system 18 can be set up to sense other characteristics indicating the operation of the light source 16, such as the application of a voltage to the light source 16. The counter 20 continues to count to accumulate total time of lamp operation until the sensing system 18 senses that the flow of current, repetitive pulses of current, or some other characteristic has stopped and then signals the counter 20 to stop counting.

The accumulated count on the counter 20 may be shown on the display 22 and/or may be stored in memory 36. When the count in the counter 20 exceeds the stored count for the life expectancy of that light source 16, then the counter 20 displays a signal indicating that the light source 16 should be replaced. By way of example, the typical life expectancy for Many deuterium light sources is about 1000 hours or 2000 hours, depending on the particular light source. When the count in the counter 20 reaches 1000 hours or 2000 hours, the display 22 may show 8888 or some other designation not in sequence with the count to signal that the light source needs to be replaced.

If the lamp power supply 32 is turned off or disconnected, the backup power supply 40 continues to provide power to components of the elapsed time indicator system 12, such as the display 22. As a result, by activating a user input device 38, such as a pressing a button, the accumulated count for the light source 16 can be shown on the display 22.

The present invention provides an effective and accurate system and method for monitoring usage of a lamp assembly. As a result, after extended use an operator of a lamp system 10 knows when it is time to replace the light source 16 before the light source 16 actually expires.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. A lamp system comprising:

a light source; and an elapsed time indicator system coupled to the light source which accumulates a count of elapsed time of operation of the light source, wherein the elapsed time indicator system further comprises:

a counter that maintains the count of elapsed time of operation of the light source;

a sensing system that senses when the light source is in operation, the counter advances the count when the sensing system senses that the light source is in operation; and a display that displays the count of elapsed time of operation, wherein the display provides an expiration signal when the count reaches a set number, the expiration signal does not correspond to and is not in sequence with the count.

2. The system as set forth in claim 1 further comprising at least one power supply, the light source and the elapsed time indicator system coupled to the at least one power supply.

3. The system as set forth in claim 2 wherein the light source further comprises:

an envelope;

an anode in the envelope, the anode coupled to the power supply; and a cathode filament in the envelope, the cathode filament coupled to the power supply.

4. The system as set forth in claim 1 wherein the sensing system senses when the lamp system is in operation by sensing when current is flowing to the light source.

5. The system as set forth in claim 1 wherein the sensing system senses when the lamp system is in operation by sensing an application of repetitive pulses of current to the light source.

6. The system as set forth in claim 1 wherein the sensing system senses when the lamp system is in operation by sensing an application of a voltage to the light source.

7. The system as set forth in claim 1 wherein the sensing system senses that the lamp assembly is not in operation, the counter stops the count of elapsed time of operation when the sensing system senses the lamp source is not in operation.

8. The system as set forth in claim 7 wherein the sensing system senses when the lamp system is not in operation by sensing when current is not flowing to the light source.

9. The system as set forth in claim 7 wherein the sensing system senses when the lamp system is not in operation by sensing when there is not an application of repetitive pulses of current to the light source.

10. The system as set forth in claim 7 wherein the sensing system senses when the lamp system is not in operation by sensing when there is not an application of a voltage to the light source.

11. The system as set forth in claim 1 wherein the elapsed time indicator system further comprises another power supply for operating the counter, the sensing system and the display.

12. The system as set forth in claim 1 wherein the elapsed time indicator system further comprises a memory for storing the count of elapsed time of operation.

13. The system as set forth in claim 12 wherein the elapsed time indicator system further comprises another power supply for operating the counter, the sensing system and the memory.

14. The system as set forth in claim 1 wherein the set number in the display is adjustable.

15. An elapsed time indicator system for a lamp assembly, the system comprising:

a sensing system that senses when the lamp assembly is in operation;

a counter that accumulates and provides a count of elapsed time of operation of the lamp assembly, the counter advances the count when the sensing system senses that the lamp assembly is in operation; and a display that displays the count of elapsed time of operation, wherein the display provides an expiration signal when the count reaches a set number, the expiration signal does not correspond to and is not in sequence with the count.

16. The system as set forth in claim 15 wherein the sensing system senses when the lamp assembly is in operation by sensing when current is flowing to the lamp assembly.

17. The system as set forth in claim 15 wherein the sensing system senses when the lamp assembly is in operation by sensing an application of repetitive pulses of current to the lamp assembly.

18. The system as set forth in claim 15 wherein the sensing system senses when the lamp assembly is in operation by sensing an application of a voltage to the lamp assembly.

19. The system as set forth in claim 15 wherein the counter stops the count of elapsed time of operation when the sensing system senses that the lamp assembly is not in operation.

20. The system as set forth in claim 19 wherein the sensing system senses when the lamp assembly is not in operation by sensing when current is not flowing to the lamp assembly.

21. The system as set forth in claim 19 wherein the sensing system senses when the lamp assembly is not in operation by sensing when there is not an application of repetitive pulses of current to the lamp assembly.

22. The system as set forth in claim 19 wherein the sensing system senses when the lamp assembly is not in operation by sensing when there is not an application of a voltage to the lamp assembly.

23. The system as set forth in claim 15 wherein the elapsed time indicator system further comprises another power supply for operating the counter, the sensing system and the display.

24. The system as set forth in claim 15 wherein the elapsed time indicator system further comprises a memory for storing the count of elapsed time of operation.

25. The system as set forth in claim 24 wherein the elapsed time indicator system further comprises another power supply for operating the counter, the sensing system, the display, and the memory.

26. The system as set forth in claim 15 wherein the set number in the display is adjustable.

27. A method for monitoring usage of a lamp system, the method comprising:

sensing when the lamp system is in operation;

advancing a count when the sensing indicates the lamp system is in operation, the count provides an indication of a life span of the lamp system;

displaying the count of elapsed time of operation; and providing an expiration signal when the count reaches a set number, the expiration signal does not correspond to and is not in sequence with the count.

28. The method as set forth in claim 27 wherein the sensing system senses when the lamp system is in operation by sensing when current is flowing in the lamp system.

29. The method as set forth in claim 27 wherein the sensing system senses when the lamp system is in operation by sensing when repetitive pulses of current are being applied to the lamp system.

30. The method as set forth in claim 27 wherein the sensing system senses when the lamp system is in operation by sensing an application of a voltage to the light source.

31. The method as set forth in claim 27 further comprising:

sensing when the lamp system is not in operation; and stopping the count when the sensing system senses the lamp system is not in operation.

32. The method as set forth in claim 31 wherein the sensing when the lamp system is not in operation further comprises sensing when current is not flowing to the lamp system.

33. The method as set forth in claim 31 wherein the sensing when the lamp system is not in operation further comprises sensing when there is not an application of repetitive pulses of current to the lamp system.

34. The method as set forth in claim 31 wherein the sensing when the lamp system is not in operation further comprises sensing when there is not an application of a voltage to the lamp system.

35. The method as set forth in claim 27 further comprising storing the count of elapsed time of operation.

36. The method as set forth in claim 27 wherein the set number is adjustable.

* * * * *